US011284776B2

(12) United States Patent
Dirnberger et al.

(10) Patent No.: US 11,284,776 B2
(45) Date of Patent: Mar. 29, 2022

(54) TABLET DOSING SYSTEM AND WATER-CARRYING DOMESTIC CLEANING APPARATUS EQUIPPED THEREWITH

(71) Applicant: emz-Hanauer GmbH & Co. KGaA, Nabburg (DE)

(72) Inventors: Albert Dirnberger, Neunburg vorm Wald (DE); Sophia Grimm, Schmidgaden/Trisching (DE); Georg Spiessl, Altendorf (DE); Peter Nitsche, Beilngries (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 117 days.

(21) Appl. No.: 16/720,204

(22) Filed: Dec. 19, 2019

(65) Prior Publication Data

US 2020/0196830 A1 Jun. 25, 2020

(30) Foreign Application Priority Data

| | | |
|---|---|---|
| Dec. 22, 2018 | (DE) | 102018010122.4 |
| May 29, 2019 | (CN) | 201910460008.9 |
| Aug. 1, 2019 | (CN) | 201910710682.8 |

(51) Int. Cl.

| | |
|---|---|
| ***A47L 15/42*** | (2006.01) |
| ***A47L 15/44*** | (2006.01) |
| ***D06F 39/02*** | (2006.01) |

(52) U.S. Cl.

CPC ..... *A47L 15/4463* (2013.01); *A47L 15/4257* (2013.01); *A47L 15/4472* (2013.01); *D06F 39/028* (2013.01)

(58) Field of Classification Search

None

See application file for complete search history.

(56) References Cited

U.S. PATENT DOCUMENTS

| | | | | |
|---|---|---|---|---|
| 6,701,944 | B2 | 3/2004 | McNabb et al. | |
| 9,717,393 | B2 | 8/2017 | Delgado et al. | |
| 2015/0257627 | A1* | 9/2015 | Park | A47L 15/483 34/72 |

FOREIGN PATENT DOCUMENTS

| | | | |
|---|---|---|---|
| DE | 4344205 | A1 | 6/1995 |
| DE | 19540958 | A1 | 5/1997 |

(Continued)

OTHER PUBLICATIONS

DE Office Action in co-pending application DE 10 2018 010 122.4, dated Dec. 13, 2019.

*Primary Examiner* — Levon J Shahinian

(74) *Attorney, Agent, or Firm* — Hayes Soloway PC

(57) ABSTRACT

A tablet dosing system, in particular for a domestic dishwasher, includes a magazine for stocking cleaning tablets in a plurality of stacks arranged side by side in a row, and an extractor for extracting cleaning tablets from the magazine. The extractor comprises an extractor member which is arranged to be movable relative to the magazine and which is adapted, without changing the position of the stacks, to serve each of the stacks for the purpose of extracting cleaning tablets. The extractor member is in the form of an extractor roller having a plurality of extraction pockets distributed along the roller axis for each receiving at least one cleaning tablet from the stacks or the extractor member is in the form of a linearly movable extractor slider which is able to serve two adjacent stacks alternately for the purpose of tablet extraction.

1 Claim, 13 Drawing Sheets

(56) References Cited

FOREIGN PATENT DOCUMENTS

| | | | |
|---|---|---|---|
| DE | 60225529 | T2 | 4/2009 |
| DE | 102015109396 | A1 | 12/2015 |
| DE | 102013210397 | A1 | 12/2017 |
| DE | 102016210397 | A1 | 12/2017 |
| EP | 1159913 | A1 | 12/2001 |
| WO | 02058528 | A1 | 8/2002 |

* cited by examiner 50c
46c
52c
62c
72c
64c
76c
54c
66c
68c
44c
74c
82c
78c
80c
56c
72c 68c
66c
78c
76c
72c
74c
80c
82c
36c
16c
46c
64c
50c
56c
44c

TABLET DOSING SYSTEM AND WATER-CARRYING DOMESTIC CLEANING APPARATUS EQUIPPED THEREWITH

BACKGROUND OF THE INVENTION

1. Field of the Invention

The present invention relates generally to a tablet dosing system and a water-carrying domestic cleaning apparatus equipped with such a tablet dosing system.

2. Description of the Prior Art

In conventional domestic washing machines and dishwashers, various cleaning substances are added to the washing water that is used in order to improve or make possible the cleaning action. Such cleaning substances are conventionally obtainable in different administration forms, for example liquid, gel-like, powdered or compacted into tablet form. In particular in the case of domestic dishwashers, the tablet form has been found to be a popular administration form among end-users. On the one hand, the tablet form permits simple handling of the cleaning additive, and on the other hand, the user is largely relieved of dosing tasks since he only has to count out the number of cleaning tablets to be added (in conventional dishwashers, a single cleaning tablet per operating cycle of the machine is usually sufficient).

Conventional domestic dishwashers have a compartment in the inside wall of the machine door that faces the washing chamber when the door is closed, which compartment can be closed by a flap and into which the user has to place a cleaning tablet before each operating cycle of the machine. During the operating cycle, the flap springs open at a defined point in time or under defined conditions, so that the cleaning tablet can fall into the washing chamber and combine therein with the washing water. In order to reduce the operating effort for the user, it is desirable if the user does not manually have to place a cleaning tablet into such a tablet compartment at the start of each new operating cycle. Instead, an automatic tablet dosing system would be desirable which relieves the user of the task of having to concern himself with the dosed addition of a cleaning agent each time he operates the dishwasher.

For prior art relating to automatic tablet dosing systems for dishwashers, reference is made to DE 195 40 958 A1, DE 43 44 205 A1 and WO 02/058528 A1.

SUMMARY OF THE INVENTION

It is an object of the present invention to provide a tablet dosing system which, with a comparatively large capacity, permits the automatic dosing of in particular cleaning tablets of quadrangular shape.

In order to achieve this object, the present invention provides according to one aspect a tablet dosing system which is suitable in particular for a domestic dishwasher and comprises a magazine and an extractor. The magazine serves to stock cleaning tablets in a plurality of stacks arranged side by side in a row. The extractor serves to extract cleaning tablets from the magazine and comprises an extractor member which is arranged to be movable relative to the magazine and which is adapted, without changing the position of the stacks, to serve each of the stacks for the purpose of extracting cleaning tablets.

In the solution according to the invention, the magazine makes it possible to stock cleaning tablets not only in a single stack but in a plurality of stacks which are arranged side by side in a row which in particular is straight. For a given installation height which is available for the installation of the tablet dosing system, for example, in the door of a domestic dishwasher, the magazine can provide a correspondingly larger capacity for cleaning tablets than an magazine that provides space for only a single tablet stack. Arranging the stacks side by side in a row leaves the overall depth substantially unchanged in comparison with a single-stack magazine.

In the solution according to the invention, the extractor comprises an extractor member (which can also be referred to as a dosing member), which is able to serve each of the plurality of stacks without the stack in question having to be moved to a specific, defined service position. Instead, the extractor member has a range which allows the extractor member to serve each of the stacks with the aim of extracting cleaning tablets, despite the fixed position of the plurality of stacks. The possibility of arranging the stacks in a stationary manner makes it possible, for example, to install the tablet dosing system into the door of a domestic dishwasher, namely in such a manner that the stacks are arranged side by side parallel to the door plane of the door.

The ability of the extractor member to serve each stack individually additionally makes it possible to use cleaning tablets having an outline shape which differs from a circular cylindrical shape or a spherical shape. While spherical or disk-shaped tablets can be brought together in an unordered manner in a funnel and removed by an extractor at a single, common extraction point, this is possible in the case of cleaning tablets of quadrangular shape only with difficulty, if at all. As a result of each stack being served individually by the extractor member, it is possible to leave such tablets of quadrangular shape in an ordered stack formation until the time of their extraction. The risk of the cleaning tablets becoming jammed during the extraction process can thus be kept low or even avoided completely.

In some embodiments, the extractor member is formed by an extractor slider which is arranged to be movable to and fro along the row of stacks. The extractor slider comprises at least one extraction opening (dosing opening), with which the extractor slider can selectively be moved beneath either of each of at least two stacks of the plurality of stacks. The extraction opening is so dimensioned that a cleaning tablet is able to fall from the magazine through the extractor slider.

The extractor slider, in association with each of the at least two stacks, can be movable between a first slider position, in which the extraction opening is located beneath the stack in question and allows a cleaning tablet arranged at the bottom of the stack in question to fall into the extraction opening, and a second slider position, in which the cleaning tablet that has fallen into the extraction opening is able to fall downwards out of the extraction opening. In the first slider position, a cleaning tablet accordingly falls from one of the stacks into the extraction opening. By displacing the extractor slider from the first slider position into the second slider position, the cleaning tablet located in the extraction opening is then transferred into a position in which it can leave the extraction opening at the bottom and, for example, can fall into a delivery chute of the tablet dosing system. The delivery chute can also be referred to as a fall chute or fall channel.

In some embodiments, the extractor member is formed by an extractor roller which is arranged to be rotatable about a roller axis which is parallel to the row of stacks. The extractor roller comprises, distributed along the roller axis, at least one extraction pocket associated with each of the plurality of stacks. Each extraction pocket is so dimensioned that a cleaning tablet is able to fall from the magazine into the extraction pocket in question. By rotating the extraction roller about the roller axis, for example through approximately 180 degrees, a cleaning tablet that has fallen into an extraction pocket of the extractor roller can be transferred into a position in which it can fall out of the extraction pocket, for example into a delivery chute of the tablet dosing system.

For at least two stacks of the plurality of stacks, the extraction pockets associated with the at least two stacks can be offset relative to one another from stack to stack in the circumferential direction of the roller. This allows different stacks to be served by the extractor roller in a manner that is offset in terms of time.

It has been shown that heat can under some circumstances adversely affect the cleaning tablets stocked in the magazine. Heat protection for the cleaning tablets stocked in the magazine can be achieved by means of a forced air stream, which is introduced into the magazine or/and flows along the magazine walls on the outside. For this purpose, a blower arrangement for generating a blowing air stream for cooling the magazine is provided in some embodiments. The blowing air is advantageously obtained from outside the cleaning apparatus in which the tablet dosing system is installed. In the case of a dishwasher which is used in a private household, a blowing air stream having a temperature corresponding to the room temperature of the private dwelling of typically between approximately 18° C. and approximately 25° C. can be generated in this manner.

Conventional cleaning programs of dishwashers generate a temperature of approximately 50° C. or more in the washing chamber of the machine only during comparatively short phases. During other phases of a program cycle, the water temperature (and thus the air temperature) in the washing chamber is often below that temperature, for example during phases in which the dishes are being pre-rinsed with comparatively cold water in order to carry out rough pre-cleaning of the dishes. In view of this, it is provided in some embodiments that the fan arrangement is so controlled that it generates the blowing air stream at least during and in particular only during a high-temperature sub-phase of a cleaning program of the cleaning apparatus. A high-temperature sub-phase is, for example, a sub-phase in which the water temperature of the cleaning water is at least 50° C.

In some embodiments, the magazine and the extractor are part of a structural unit which can be pre-assembled and installed as such into the door, for example behind an outer paneling of the door.

According to a further aspect, the present invention provides a water-carrying domestic cleaning apparatus comprising a wet chamber, a door for closing the wet chamber, and a tablet dosing system of the type described above installed in the door. The tablet dosing system comprises a delivery outlet for delivering a cleaning tablet extracted by means of the extractor into the wet chamber. The cleaning apparatus is, for example, a domestic dishwasher.

According to yet a further aspect, the invention provides a water-carrying domestic cleaning apparatus, in particular a dishwasher, wherein the cleaning apparatus comprises a wet chamber and a door for closing the wet chamber. The door provides a storage chamber for receiving a supply of a cleaning substance, wherein a loading access for loading the storage chamber with the cleaning substance is provided in the door. Concealed in the door there is formed a fall channel, which discharges from the door on a wet side of the door at a mouth point. There is accommodated in the door a controllable dosing member which is configured for extracting a dose of the cleaning substance from the supply and for delivering the extracted dose into the fall channel. There is formed in the door, at a distance from the mouth point, a maintenance access which is separate from the loading access and is removably covered by a cover component, which maintenance access allows a user access to the fall channel or/and to the dosing member. Removable covering of the maintenance access by the cover component means that the cover component can be moved by the user (e.g. can be folded back, unscrewed or pushed away) in order to expose the maintenance access. The maintenance access allows maintenance work to be carried out inside the fall channel or/and on the dosing member, for example for the purpose of cleaning or if the dosing member has become blocked. The cleaning substance which is stocked in the storage space and can be dosed by means of the dosing member is in some embodiments not liquid and not in gel form but is powdered or compacted into defined shaped bodies (i.e. cleaning tablets). The wet side of the door is the side of the door that faces towards the wet chamber and is wetted during operation of the cleaning apparatus (and consequently when the door is closed).

In some embodiments, the maintenance access is formed on the wet side of the door. However, it is possible, as an alternative, to provide the maintenance access on the outer side of the door which faces away from the wet chamber when the door is in the closed state, although this will in some circumstances not be the preferred solution for reasons of the visual appearance of the cleaning apparatus.

In some embodiments, the dosing member can be removed from the door through the maintenance access. After the dosing member has been removed, at least parts of the storage chamber are in some embodiments also accessible via the maintenance access. In some embodiments, the maintenance access provides a continuous connection to the loading access at least when the dosing member has been removed. The loading access is formed, for example, in the region of a narrow side of the door or alternatively on the inside of the door, that is to say on the side of the door that faces towards the wet chamber and is exposed to the wet when the door is in the closed state. The user can use this continuous connection, for example, to introduce an optionally flexible brush through either the maintenance access or the loading access and push it through as far as the respective other access.

In some embodiments, the dosing member is concealed directly behind the cover component.

In some embodiments, the dosing member is formed by a sliding body which is mounted to be linearly movable or by a rotatably mounted rotating body (e.g. in disk or roller form).

The cover component can be formed, for example, by a cover flap, a screw cover or a sliding cover.

The invention will be explained further with reference to the accompanying drawings.

BRIEF DESCRIPTION OF THE DRAWINGS

FIGS. 9*a* to 9*d* show different phases during an automatic dosing operation of the tablet dosing system of FIG. 8.

DETAILED DESCRIPTION OF THE INVENTION

Figure 1:
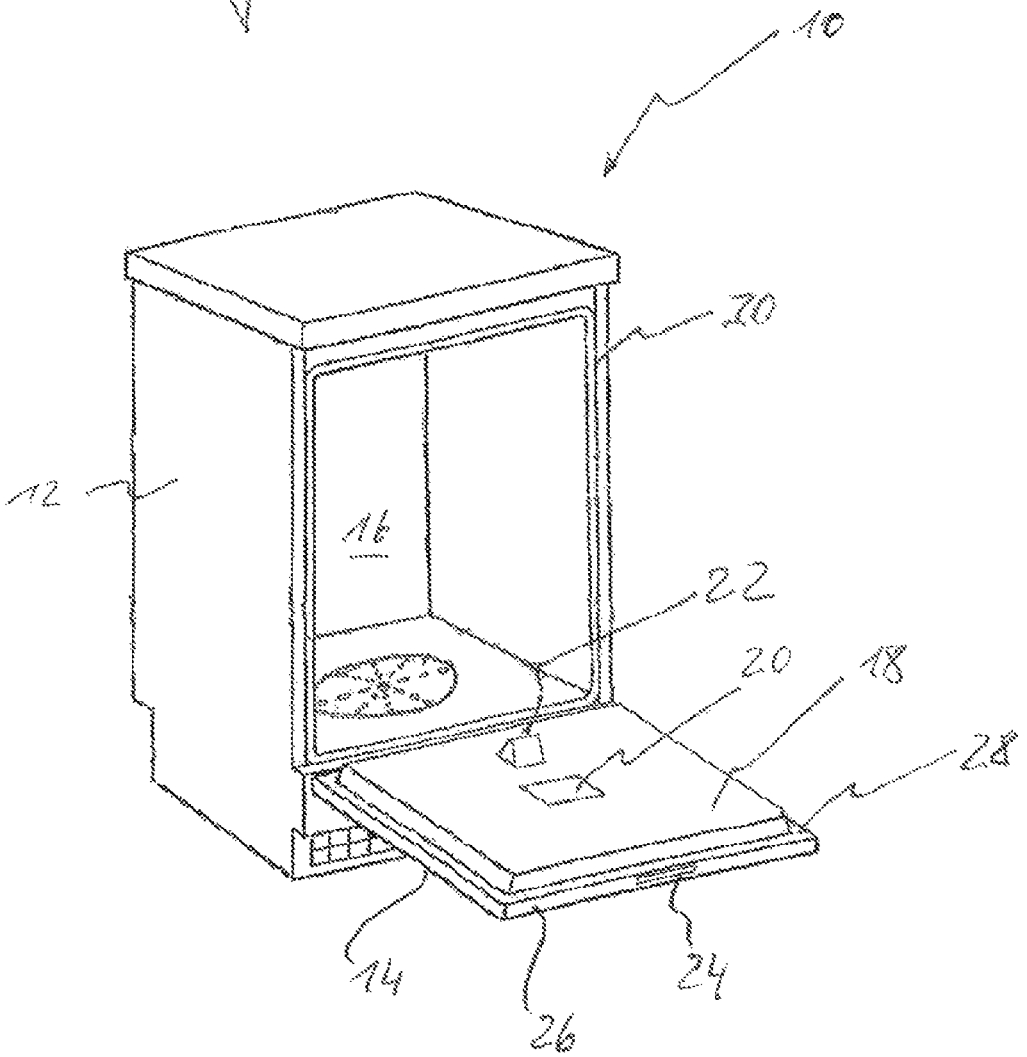
FIG. 1 is a perspective view of a domestic dishwasher with the door open according to one exemplary embodiment.

Reference will first be made to FIG. 1. The dishwasher shown therein is designated generally 10 and has a form typical for use in a private household. The dishwasher 10 comprises a machine main body 12 to which a door 14 is attached about a horizontal pivot axis (not designated further). A wet chamber (washing chamber) 16 is formed in the machine main body 12. Although not shown in greater detail in FIG. 1, the wet chamber 16 can be equipped in a manner known per se with one or more dish racks or/and with a cutlery drawer. The door 14 serves to close the wet chamber 16 during operation of the dishwasher 10.

The door 14 has an inside wall 18 which faces towards the wet chamber 16 when the door is in the closed state and which is formed, for example, by a metal interior lining. A maintenance flap 20 is arranged on the inside wall 18 of the door 14, which maintenance flap can be opened by the user if required and, in the closed state, blocks an access opening formed in the inside wall 18. In the open state, the maintenance flap 20 allows the user access through the mentioned access opening to an extractor member (which in the exemplary embodiment under consideration here can also be described as a tablet separator). The extractor member is part of a tablet dosing system, which will be described in greater detail below, and is concealed behind the maintenance flap 20 when the maintenance flap is closed. By opening the maintenance flap 20, a user can obtain access to the extractor member and can remove the extractor member through the access opening. This may be necessary for maintenance or cleaning purposes, for example if tablets have become jammed in the tablet dosing system. The access opening accordingly provides a maintenance access. The user can first try to eliminate the fault himself and, if necessary, clean the internal regions of the tablet dosing system by opening the maintenance flap 20 and removing the extractor member, before—if the user remains unsuccessful—customer services have to be called. The maintenance flap 20 can be resiliently biased in the direction towards its closed position by suitable spring means. The tablet dosing system further includes a delivery outlet 22 which is likewise arranged on the inside wall 18 of the door 14 and serves to deliver or, specifically, to eject cleaning tablets into the wet chamber 16.

The tablet dosing system further includes a loading flap 24 which covers a loading access which allows a user to fill a magazine, not shown in greater detail in FIG. 1, which is concealed behind the inside wall 18, with new cleaning tablets. The cleaning tablets introduced via the loading flap 24 are collected in said magazine, from where they are removed by means of the extractor member in a dosed amount, in particular singly, and ultimately travel via an ejection chute, which is likewise concealed behind the inside wall 18, to the delivery outlet 22, where they emerge into the wet chamber 16. The delivery outlet 22 forms a mouth point at which the mentioned ejection chute discharges on the wet side of the door 14. It will be seen that the loading flap 24 in the example shown is arranged on a narrow side 26 of the door which is located at the top when the door 14 is closed and thus vertical and is therefore easily accessible for the user. This narrow side 26 lies outside sealing bead contact surfaces 28 which are formed on the interior lining of the door 14 forming the inside wall 18 and, when the door 14 is closed, are oriented towards the machine main body 12 (i.e. towards the wet chamber 16). The sealing bead contact surfaces 28 serve for contact of an elastomeric sealing bead 30 which is arranged on the front side of the machine main body 12 and extends around the wet chamber 16 and which, when the door 14 is closed, is compressed as a result of contact with the sealing bead contact surfaces 28 of the door 14 and thus serves to seal the wet chamber 16 to the outside. The loading flap 24 is consequently arranged outside the sealing barrier that prevents moist hot air from escaping from the wet chamber 16 between the machine main body 12 and the door 14 during washing operation of the dishwasher 10.

Figure 2:
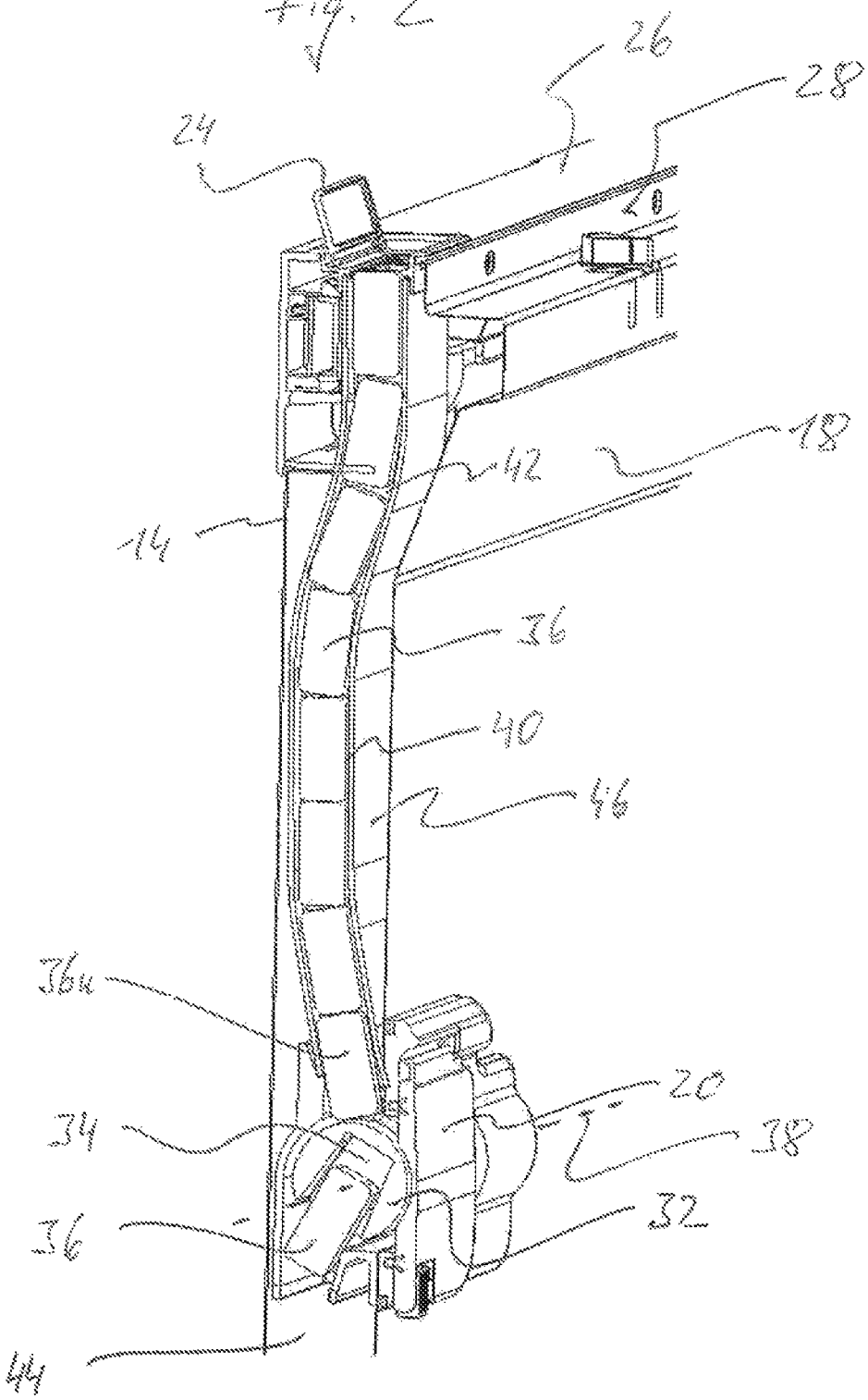
FIG. 2 shows a tablet dosing system according to one exemplary embodiment, installed in the door of a dishwasher and with a partially cutaway perspective view of the door.

Reference will now be made to the exemplary embodiment of FIGS. 2 and 3. In FIG. 2 there can be seen the mentioned extractor member, which in the example shown is formed by an extractor roller 32. The extractor roller 32, which is arranged behind the maintenance flap 20, comprises a plurality of extraction pockets 34 (in the example shown a total of two), which are each so dimensioned that a defined number of cleaning tablets 36 of quadrangular shape in outline can be received in the extraction pocket 34 in question. In the example shown, the defined number is one, but it is not limited thereto. The extractor roller 32 is rotatably mounted about a roller axis 38 and can be driven about the roller axis 38 by an electromotive drive which is not shown in greater detail in the drawings. In the example shown, the roller axis 38 extends parallel to the door plane of the door 14 in the horizontal direction. The extraction pockets 34 are each in the form of a recess which is formed in the roller shell, that is to say in the circumferential surface of the extractor roller 32.

The extractor roller 32 can be adjusted into different rotational positions. In a first rotational position, one of the extraction pockets 34 is located with its open pocket opening directly beneath a cleaning tablet 36*u* which is at the bottom of a tablet stack 40 stored in a storage chamber 42. In a second rotational position (depicted in FIG. 2), the extractor roller 32 is located with the open pocket opening of the extraction pocket 34 in question above the upper end of an ejection chute forming an ejection channel (fall channel) 44. In the first rotational position of the extractor roller 32, the cleaning tablet 36*u* can consequently fall into the extraction pocket 34 in question under the force of gravity. By rotation of the extractor roller 32 about the axis of rotation 38 into the second rotational position, the cleaning tablet 36*u* located in the extraction pocket 34 in question can be transferred into a delivery position, in which the cleaning tablet 36*u* can fall out of the extraction pocket 34 in question into the ejection channel 44.

The storage chamber 42 is formed by a magazine 46 which is installed behind the inside wall 18 of the door 14. The storage chamber 42 extends as far as the loading flap 24, so that the user is able to introduce new cleaning tablets 36 into the storage chamber 42 via the loading flap 24. In the example shown, the cleaning tablets 36 are located in the storage chamber 42 in an ordered stack. Stocking the cleaning tablets 36 in an ordered manner in the storage chamber 42 is advantageous in the case of cleaning tablets that are approximately quadrangular in shape, as shown in FIG. 2, in order to ensure that the extractor roller 32 can reliably pick up individual cleaning tablets 36 (i.e. can reliably allow them to slide into a respective one of the extraction pockets 34). The tablet stack in the storage chamber 42 is so oriented that the cleaning tablets 36 in the stack are able to slide down solely under the force of gravity and no additional feed means is required to push the stocked cleaning tablets 36 in the direction towards the extractor roller 32. As shown in FIG. 2, the individual cleaning tablets 36 are for this purpose located in the tablet stack in an arrangement in which they are largely vertically above one another. The cleaning tablets 36 are located with their short narrow sides against one another, that is to say they are arranged on edge one above the other. In other embodiments, the cleaning tablets 36 can be arranged with their flat sides or with their long narrow sides against one another.

Figure 3:
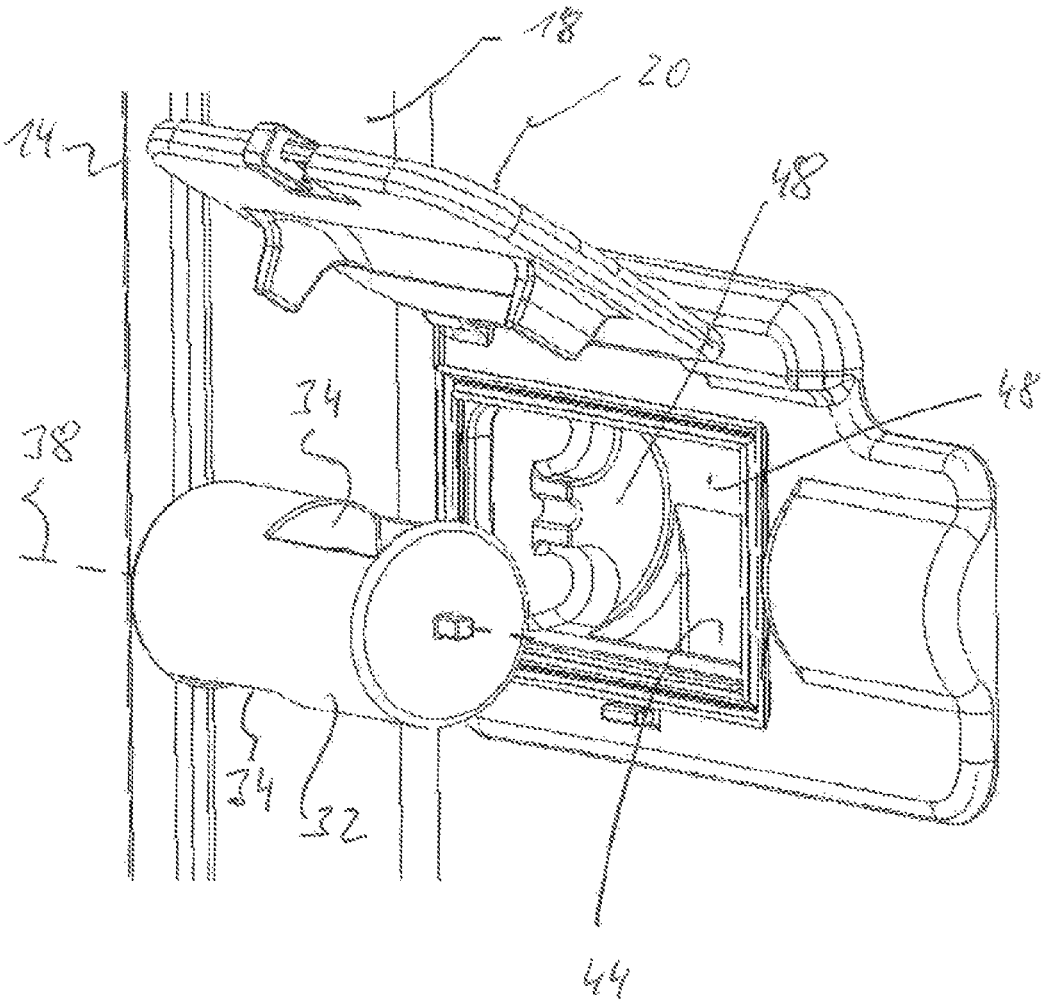
FIG. 3 shows, in an enlarged view, details of the tablet dosing system of FIG. 2.

In order to increase the quantity of cleaning tablets 36 which can be stocked in the magazine 46, the magazine is designed in the example of FIGS. 2 and 3 not only to receive a single tablet stack but to receive a plurality of tablet stacks which are arranged side by side in a horizontal row. All these tablet stacks are served jointly by the extractor roller 32. The magazine 46 is installed in the door 14 in a stationary manner, for which reason the individual tablet stacks as such are also arranged in unchangeable, fixed stack positions in the door 14. The extractor roller 32 has a range such that it is able to serve all the tablet stacks (i.e. can extract cleaning tablets 36 from every tablet stack) without the stack positions relative to the door 14 having to be changed. In the example of FIGS. 2 and 3 shown, the extractor roller 32 is designed to serve a total of two tablet stacks. Corresponding to this number of tablet stacks, the extractor roller is provided with a total of two extraction pockets 34, which are so distributed in the direction of the roller axis 38 that each of the extraction pockets 34 is arranged at the axial position of an associated one of the tablet stacks. Assuming that only a single cleaning tablet 36 is required for each operating cycle of the dishwasher 10, the extraction pockets 34 are so distributed in the circumferential direction of the extractor roller 32 that in each case only one of the extraction pockets 34 is located above the ejection channel 44 at any one time and accordingly only a single cleaning tablet 36 can be delivered at any one time from the tablet dosing system into the wet chamber 16. In the example shown with a total of two tablet stacks and two extraction pockets 34 formed in the extractor roller 32, each of which is associated with one of the tablet stacks, the two extraction pockets 34 are, for example, offset relative to one another in the circumferential direction of the roller by 180 degrees. Such a form of the extractor roller 32 can be seen in FIG. 3.

The distribution pattern of the extraction pockets 34 on the roller shell of the extractor roller 32 can be such that, in every rotational position in which one of the extraction pockets 34 is ready to receive a cleaning tablet 36 from one of the tablet stacks, another of the extraction pockets 34 is at the same time located above the ejection channel 44. The picking up of a new cleaning tablet 36 by the extractor roller 32 is then accompanied at the same time by the release of another, previously picked up cleaning tablet 36 from the extractor roller 32 into the ejection channel 44. In the example according to FIG. 3, each rotation of the extractor roller 32 through 180 degrees leads to a new cleaning tablet 36 falling into one of the extraction pockets 34 and at the same time a cleaning tablet 36 being released from the other extraction pocket 34 into the ejection channel 44. In the case of three, four or five tablet stacks, the extraction pockets 34 arranged in different axial regions of the roller circumference are arranged offset relative to one another by, for example, 120 degrees, 90 degrees or 60 degrees. Moreover, it will be appreciated that the extractor roller 32 can also have more than one extraction pocket 34 per tablet stack, for example two extraction pockets. The distribution pattern of the extraction pockets 34 on the roller shell can then be so chosen, for example, that, on further rotation of the extractor roller 32 from a rotational position in which one of the extraction pockets 34 is ready to receive a cleaning tablet 36 from one of the tablet stacks into a subsequent rotational position in which the extractor roller 32 is ready next time to receive a cleaning tablet 36, that next cleaning tablet 36 is always removed from a different tablet stack. In this manner, a cleaning tablet 36 is removed from each tablet stack in a given order, before the next removal cycle begins, in which a cleaning tablet 36 is again removed from each tablet stack in the same order. It will be appreciated that any desired orders of the removal of cleaning tablets 36 from the tablet stacks can be achieved via the distribution pattern of the extraction pockets 34 on the roller shell.

The extraction pockets 34 are preferably so dimensioned that there is sufficient space therein for the desired number of cleaning tablets 36 (i.e. generally a single cleaning tablet 36) and the cleaning tablets do not protrude radially beyond the roller shell. This makes it possible for a roller-accommodating chamber, in which the extractor roller 32 rotates, to be made sufficiently small that the extractor roller 32 forms a sufficiently effective barrier against the escape of moist hot air from the wet chamber 16 via the ejection channel 44 through the roller-accommodating chamber into the magazine 46. The chamber walls of the roller-accommodating chamber (such chamber walls are shown at 48 in FIG. 3) can be arranged sufficiently close to the extractor roller 32 that moist hot air is able to flow through the remaining gap at most to only a small, negligible degree.

The extractor roller 32 can be driven, for example, by means of a step motor (not shown), which is driven by a control device (likewise not shown) accommodated in the door 14. A suitable sensor system can be provided for supplying a drive controller of the extractor roller 32 with information about the actual rotational position of the extractor roller 32. Such a sensor system can comprise, for example, one or more Hall sensors, electromechanical switches or/and other sensor elements for detecting the rotational position of the extractor roller 32.

In the further figures, elements which are the same or have the same effect are provided with the same reference numerals as in FIGS. 1 to 3, but with the addition of a lowercase letter. Unless indicated otherwise hereinbelow, reference is made to the above explanations relating to FIGS. 1 to 3 for the explanation of such components which are the same or have the same effect.

Figure 4:
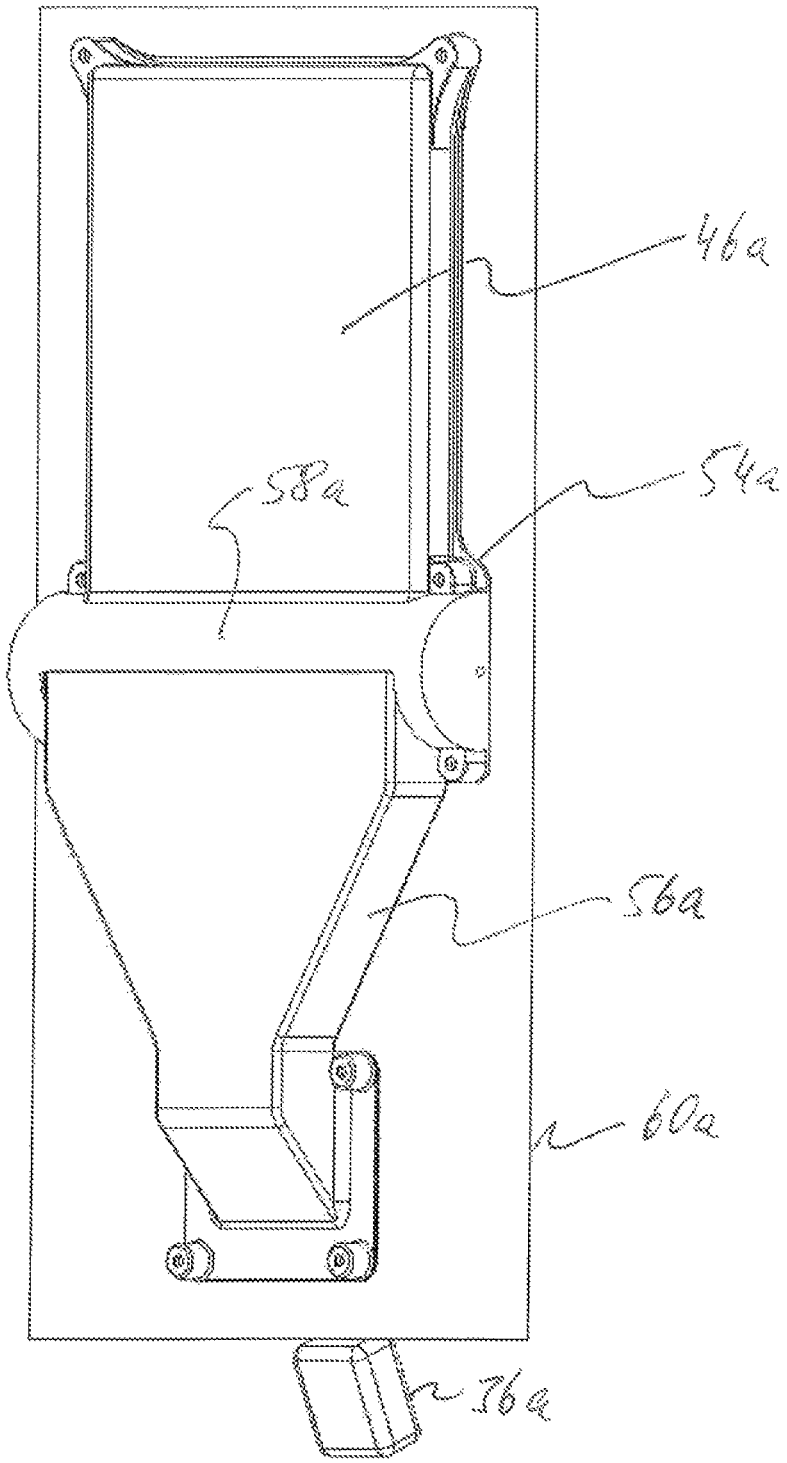
FIG. 4 is a rear view of a tablet dosing system according to a further exemplary embodiment.
Figure 5:
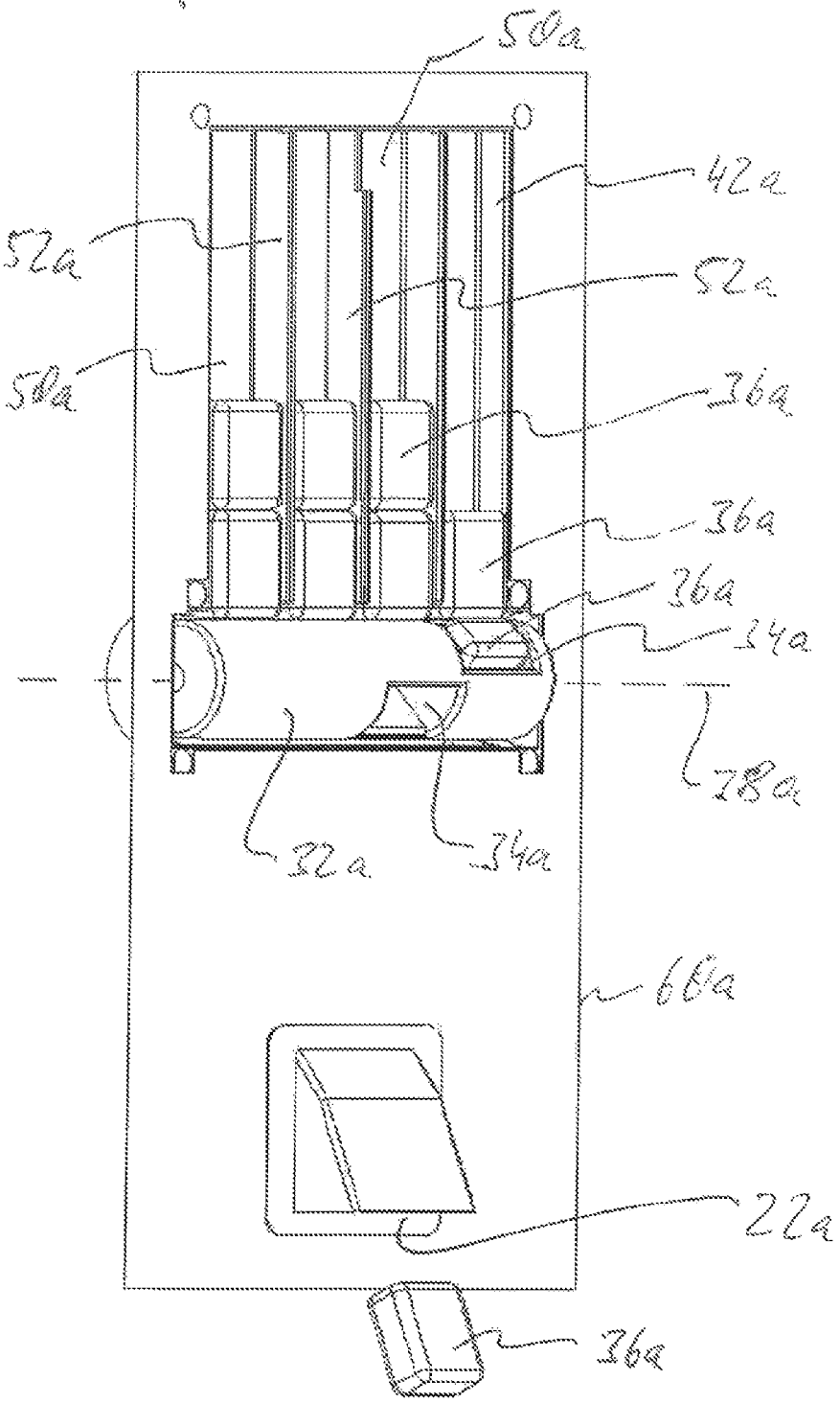
FIG. 5 is a front view of the tablet dosing system of FIG. 4.

FIGS. 4 and 5 show an exemplary embodiment of a tablet dosing system having an extractor roller 32*a* which is configured not only to serve two tablet stacks—as in the exemplary embodiment of FIGS. 2 and 3—but to jointly serve a total of four tablet stacks. For each of the tablet stacks, a magazine chute 50*a* is formed in the magazine 46*a*. The various magazine chutes 50*a* are separated from one another by separating walls 52*a*. The extractor roller 32*a* has a total of four extraction pockets 34*a*, corresponding to the number of tablet stacks, which are arranged offset along the roller axis 38*a* according to the axial positions of the tablet stacks. When seen in the circumferential direction of the roller, the receiving pockets 34*a* follow one another in each case at a 90 degree interval. In the representation of FIG. 5, the receiving pocket 34*a* on the far right of the extractor roller 32*a* is shown loaded with a cleaning tablet 36*a*.

The magazine 46*a* is part of a system housing 54*a* (FIG. 4) which, in addition to the magazine 46*a*, also forms a channel housing 56*a* for the ejection channel leading to the delivery opening 22*a*, and a chamber housing 58*a* which receives the extractor roller 32*a* and forms the mentioned roller-accommodating chamber. The system housing 54*a* can be fixed as such to a wall plate 60*a* which in FIGS. 4 and 5 is shown as a rectangular plate, only for the purposes of the illustration, and can be part of the inside wall 18 (FIG. 1) of the door, for example. The system housing 54*a* can thus be mounted on the wall plate 60*a* from behind (when seen from the washing chamber of the dishwasher). The system housing 54*a* can be a one-piece component or it can be formed by a plurality of individual components which can be assembled to form a structural unit, before the structural unit is subsequently installed in the door of the dishwasher.

Figure 6:
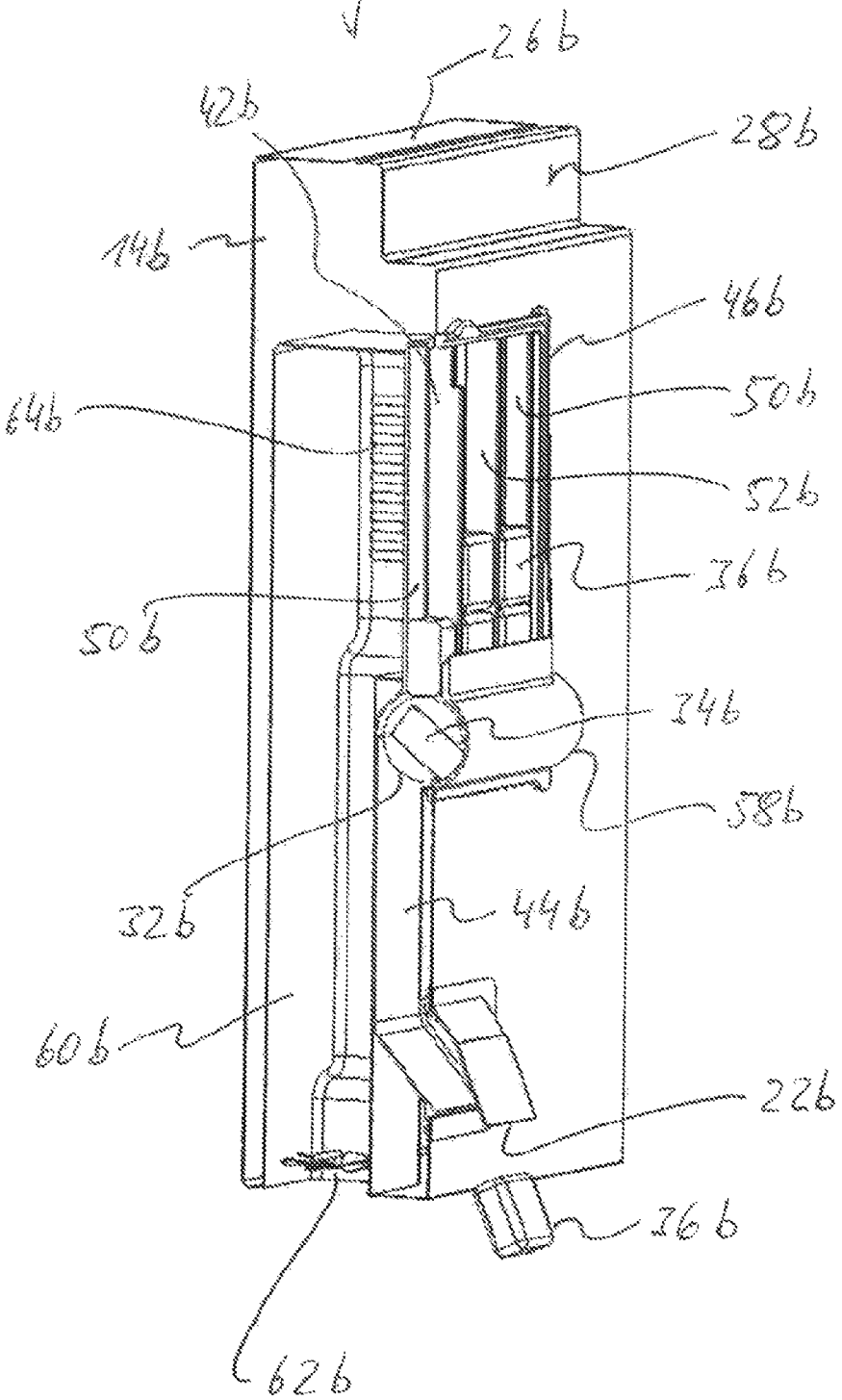
FIG. 6 is a sectional view of the door of a dishwasher having a tablet dosing system according to a further exemplary embodiment.
Figure 7:
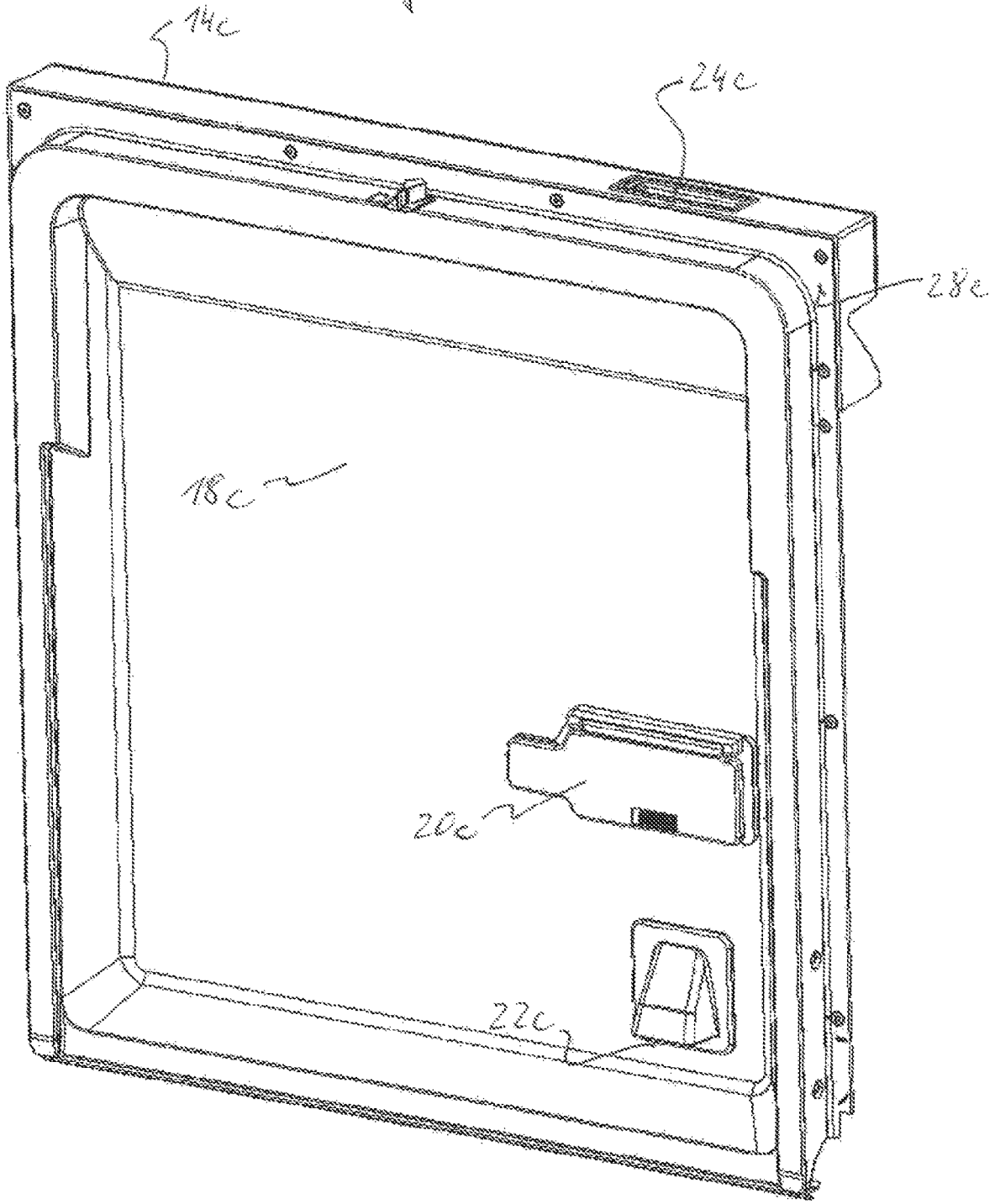
FIG. 7 is a perspective view of a dishwasher door from the side of the door facing towards the washing chamber, according to one exemplary embodiment.
Figure 8:
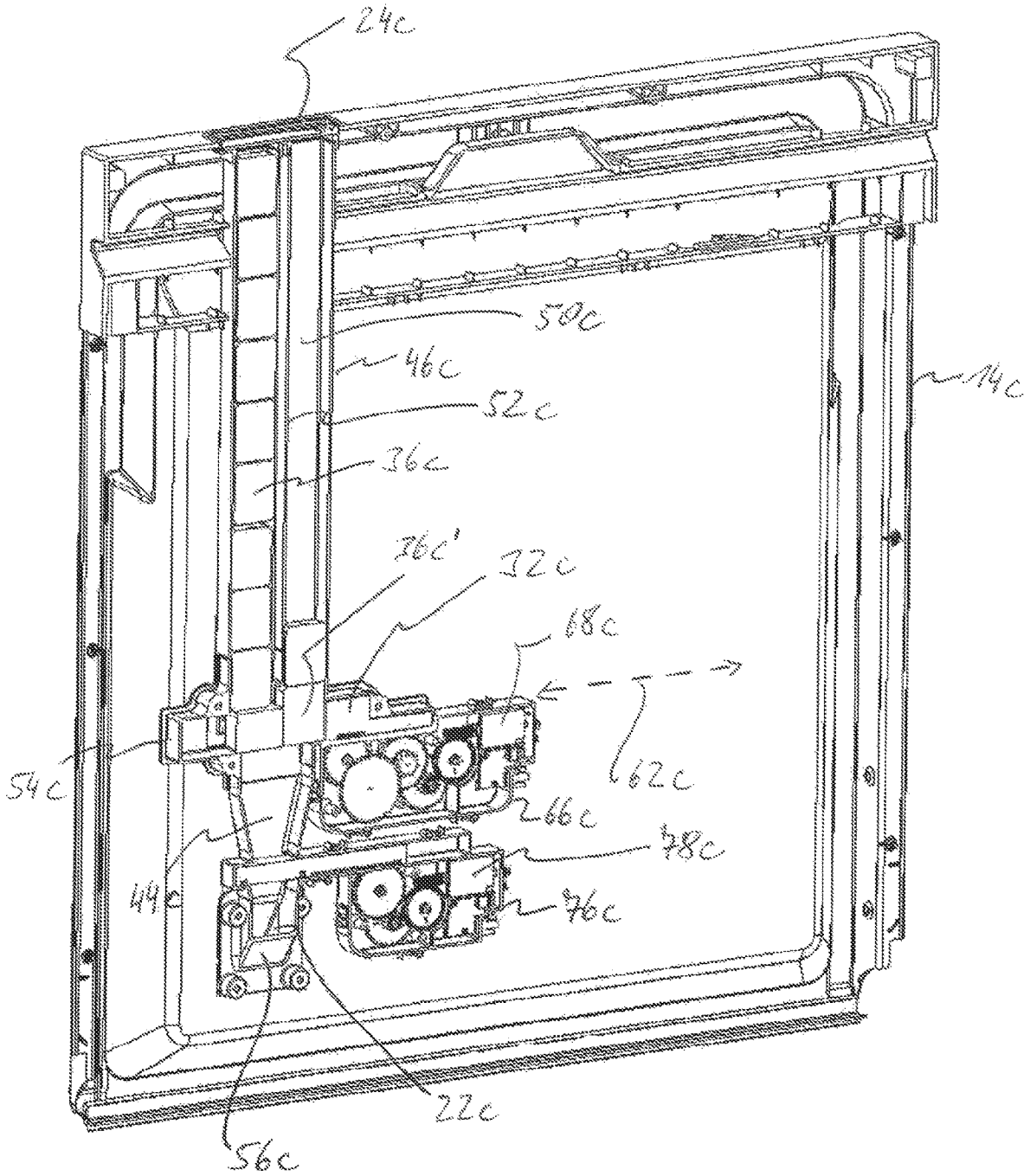
FIG. 8 shows the dishwasher door of FIG. 7 with a tablet dosing system installed therein according to a further exemplary embodiment, with the outer paneling of the dishwasher door removed.

In the exemplary embodiment of FIG. 6, which, like the exemplary embodiments of FIGS. 2 and 3 and of FIGS. 4 and 5, provides a roller-like form of the extractor member (extractor roller 32*b*), a blowing air channel 60*b* is incorporated into the door 14*b* of the dishwasher, which blowing air channel extends into the region of the magazine 46*b*. A fan 62*b*, which forms a blower arrangement within the meaning of the invention, which is likewise installed in the door 14*b* and, in the example shown, is seated in the blowing air channel 60*b*, serves to generate a blowing air stream which flows in the blowing air channel 60*b* in the direction towards the magazine 46*b*. The fan 62*b* draws in comparatively cool air from outside the dishwasher. In some embodiments, the blowing air guided to the magazine 46*b* via the blowing air channel 60*b* only passes over the outside of the magazine walls, without penetrating the interior of the magazine 46*b*. In other embodiments, the blowing air is guided into the interior of the magazine 46*b* so that it is there able to come into direct contact with the cleaning tablets 36*b* stored therein. There can be seen in FIG. 6 a plurality of slots 64*b* which are incorporated into one of the channel walls delimiting the blowing air channel 60*b* and allow the blowing air to pass from the blowing air channel 60*b* to the magazine 46*b*.

Operation of the fan 62*b* is controlled by a control device, which is not shown in greater detail. Since the washing liquor (washing water) in the washing chamber of the dishwasher usually reaches temperatures of 50° C. or more only in phases, that is to say temporarily, it may be that it is not necessary to actively cool the cleaning tablets 36*b* stored in the magazine 46*b* with blowing air for the entire duration of an operating cycle of the dishwasher. Instead, it may be sufficient to switch on the fan 62*b* only during specific high-temperature operating phases of an operating cycle in which the washing liquor or the air present in the washing chamber is at temperatures of, for example, at least 50° C.

Reference will now be made to the exemplary embodiment of FIGS. 7 to 10. In this exemplary embodiment, the extractor member is in the form of an extractor slider (dosing slider) 32*c*, which is movable to and fro in a linear sliding direction 62*c* which runs parallel to the door plane of the door 14*c* and, in the installed situation of the door dosing system, extends linearly. The sliding direction 62*c* corresponds to the direction in which the tablet stacks are arranged in rows side by side in the magazine 46*c*. The extractor slider 32*c* has an extraction opening 64*c* which is so dimensioned that the cleaning tablets 36*c*, which are of quadrangular shape in outline and are stacked on edge on top of one another, can each slide individually into the extraction opening 64*c*. The extraction opening 64*c* is designed as a fall-through opening, that is to say it allows individual cleaning tablets 36*c* to fall completely from the magazine 46*c* into the ejection channel 44*c*. The extraction opening 64*c*, unlike the extraction pockets of the exemplary embodiments of FIGS. 2, 3 and 4, 5, does not have a base and is open at the bottom.

For driving the extractor slider 32*c* in the sliding direction 62*c* there serves a first drive unit 66*c*, which in the example shown comprises an electric motor 68*c* as the power source and a reduction gear 70*c* arranged downstream thereof on the power output side. The reduction gear 70*c* (more specifically: a last toothed wheel of the reduction gear 70*c* on the output side) is in intermeshing engagement, for example, with a toothing (not visible in greater detail in the figures) formed on the extractor slider 32*c*.

The sliding range of the extractor slider 32*c* is such that the extraction opening 64*c* can selectively be moved to beneath each of the tablet stacks. Without changing the positions of the stacks, the extractor slider 32*c* can accordingly serve each of the tablet stacks and remove cleaning tablets 36*c* singly from each of the tablet stacks. In the example of FIGS. 7 to 10 shown, the magazine 46*c* provides room for two tablet stacks, but it will be appreciated that the magazine 46*c* can also be made larger, if required, and can provide space for more than two tablet stacks.

FIGS. 9*a* to 9*d* show different phases in the extraction of a cleaning tablet from the magazine 46*c*. The cleaning tablet extracted in this operation is designated 36*c*' in FIGS. 9*a* to 9*d* for the purpose of better identification.

Figure 9A:
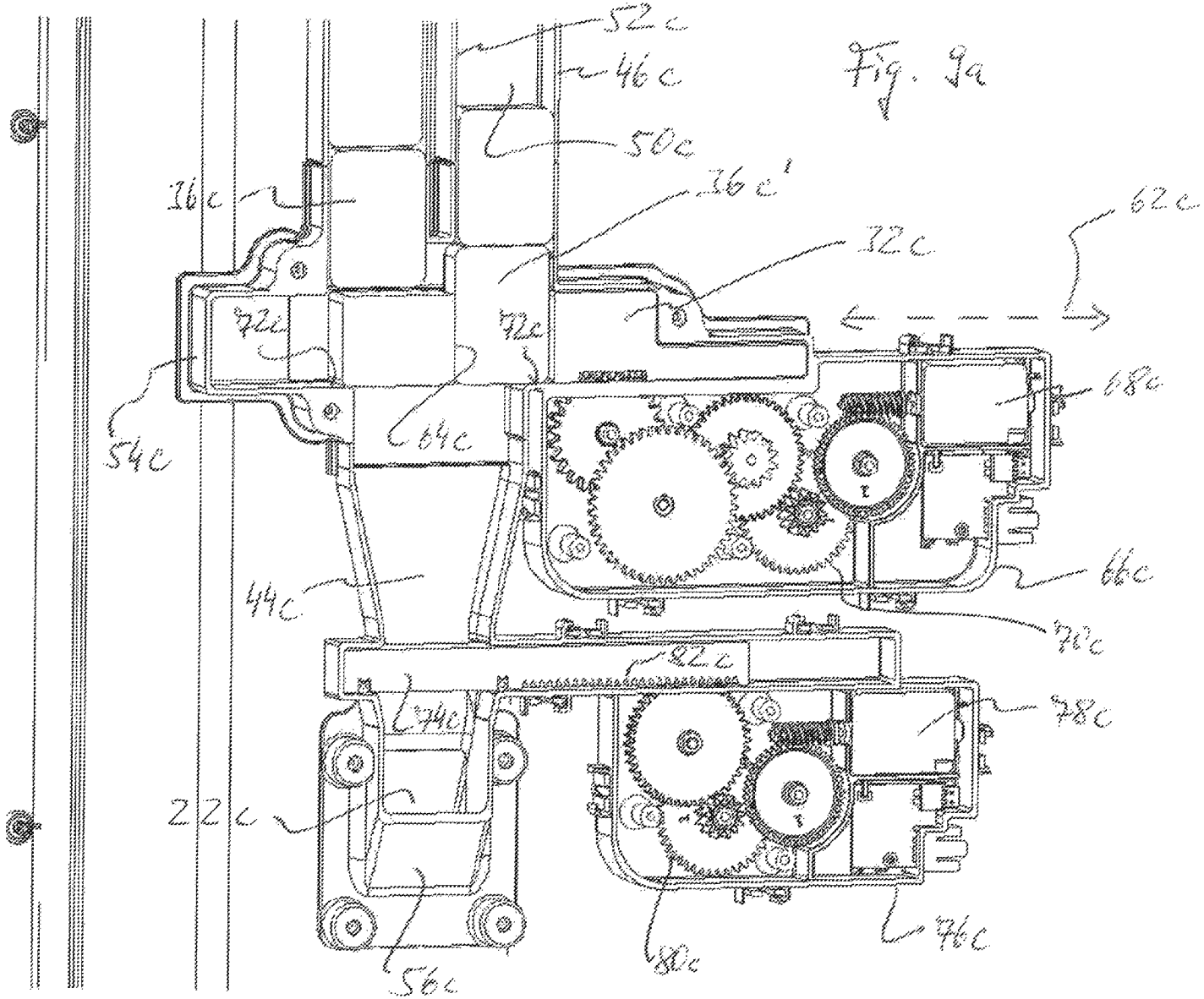

In FIG. 9*a*, the extractor slider 32*c* with the extraction opening 64*c* has been moved to beneath the tablet stack of the two tablet stacks that is on the right in the representation, so that the cleaning tablet 36*c*' was able to fall into the extraction opening 64*c*. This slider position represents a first slider position associated with the right-hand tablet stack within the meaning of the invention. In this first slider position, although the cleaning tablet 36*c*' was able to fall into the extraction opening 64*c*, it could not slide through the extraction opening 64*c* because the extractor slider 32*c* with the extraction opening 64*c* is partly located above a blocking surface 72*c* formed on the system housing 54*c*. The blocking surface 72*c* prevents the cleaning tablet 36*c*' from falling out of the extraction opening 64*c*.

In the state shown in FIG. 9*a*, the ejection channel 44*c* is blocked by a lock element 74*c*, which in the example shown is in the form of a sliding component which is movable linearly in the sliding direction 62*c* and is able to selectively block and open the ejection channel 44*c*. For driving the lock element 74*c* there serves a second drive unit 76*c*, which in the example shown comprises an electric motor 78*c* and a reduction gear 80*c* coupled thereto on the output side.

Similarly to the first drive unit 66*c*, the reduction gear 80*c* in the case of the second drive unit 76*c* is in intermeshing engagement with the lock element 74*c*; the lock element is provided with a toothing 82*c* for this purpose.

Figure 9B:
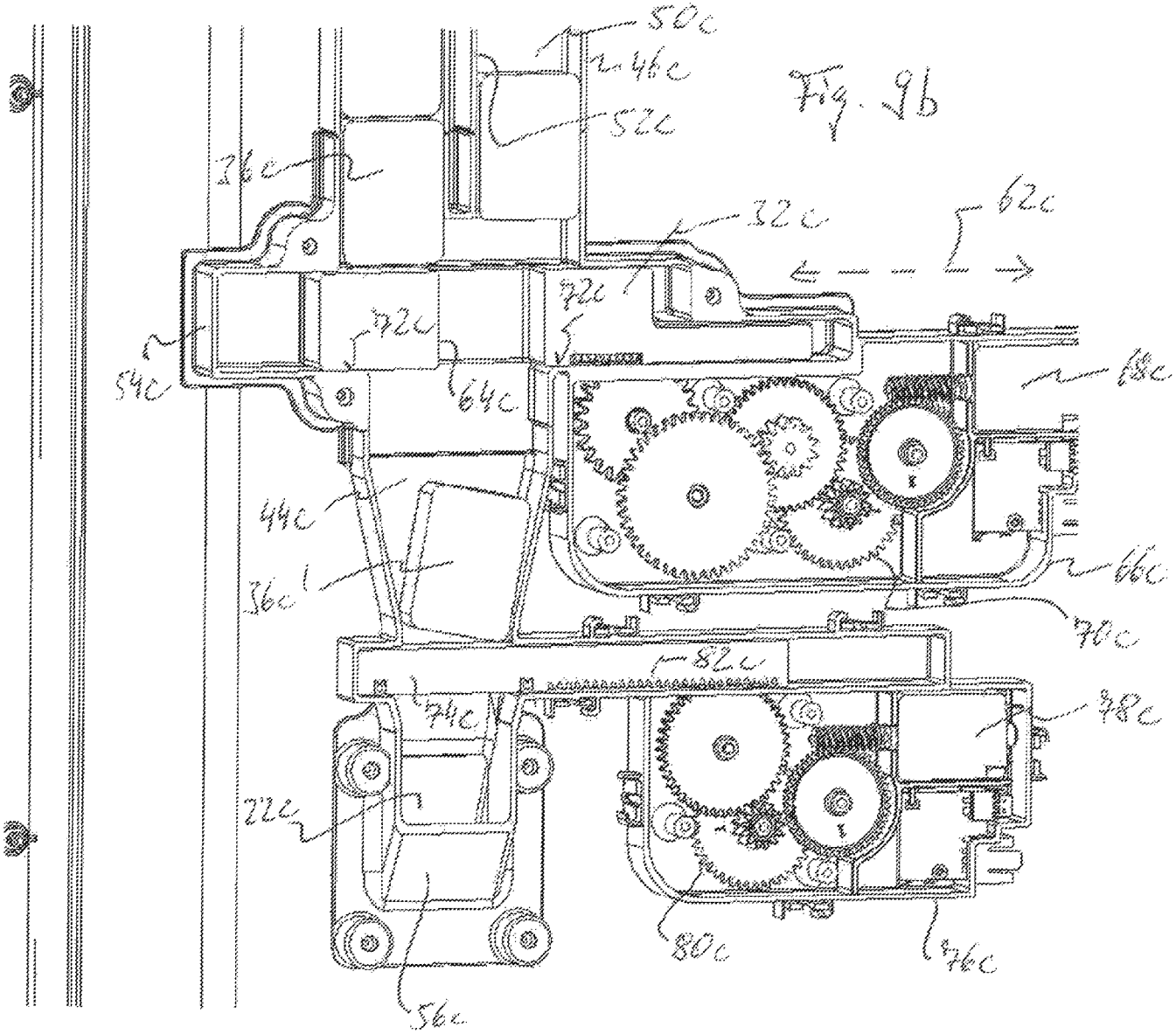

For selectively delivering the cleaning tablet 36*c*' which has slid into the extraction opening 64*c*, the extractor slider 32*c* is next moved into a second slider position, in which the extraction opening 64*c* is located wholly above the ejection channel 44*c* and out of the range of the blocking surface 72*c*. This situation is shown in FIG. 9*b*. The removal of the blocking of the cleaning tablet 36*c*' by the blocking surface 72*c* has had the effect in FIG. 9*b* that the cleaning tablet 36*c*' has fallen out of the extractor slider 32*c* and has fallen down into the ejection channel 44*c* as far as the lock element 74*c*. However, the cleaning tablet 36*c*' is prevented from falling further by the lock element 74*c* as long as the lock element is in its closed position according to FIG. 9*b*.

In the slider position according to FIG. 9*b*, although the extraction opening 64*c* of the extractor slider 32*c* is located wholly above the ejection channel 44*c*, it is not oriented vertically with respect to any of the tablet stacks. Accordingly, in the slider position according to FIG. 9*b*, a new cleaning tablet 36*c* cannot fall from any of the tablet stacks into the extraction opening 64*c*. To that end, the extractor slider 32*c* must either be moved back into the slider position according to FIG. 9*a* (if a tablet is to be removed from the right-hand tablet stack again) or the extractor slider 32*c* must be moved further beyond the slider position according to FIG. 9*b* until the extraction opening 64*c* is located beneath the left-hand tablet stack in a first slider position associated with the left-hand stack (if a tablet is to be removed from the left-hand stack). In association with the left-hand tablet stack too, the system housing 54*c* comprises a blocking surface 72*c* which prevents a cleaning tablet 36*c* which has fallen from the left-hand tablet stack into the extraction opening 64*c* from immediately sliding further into the ejection channel 44*c*.

Figure 9C:
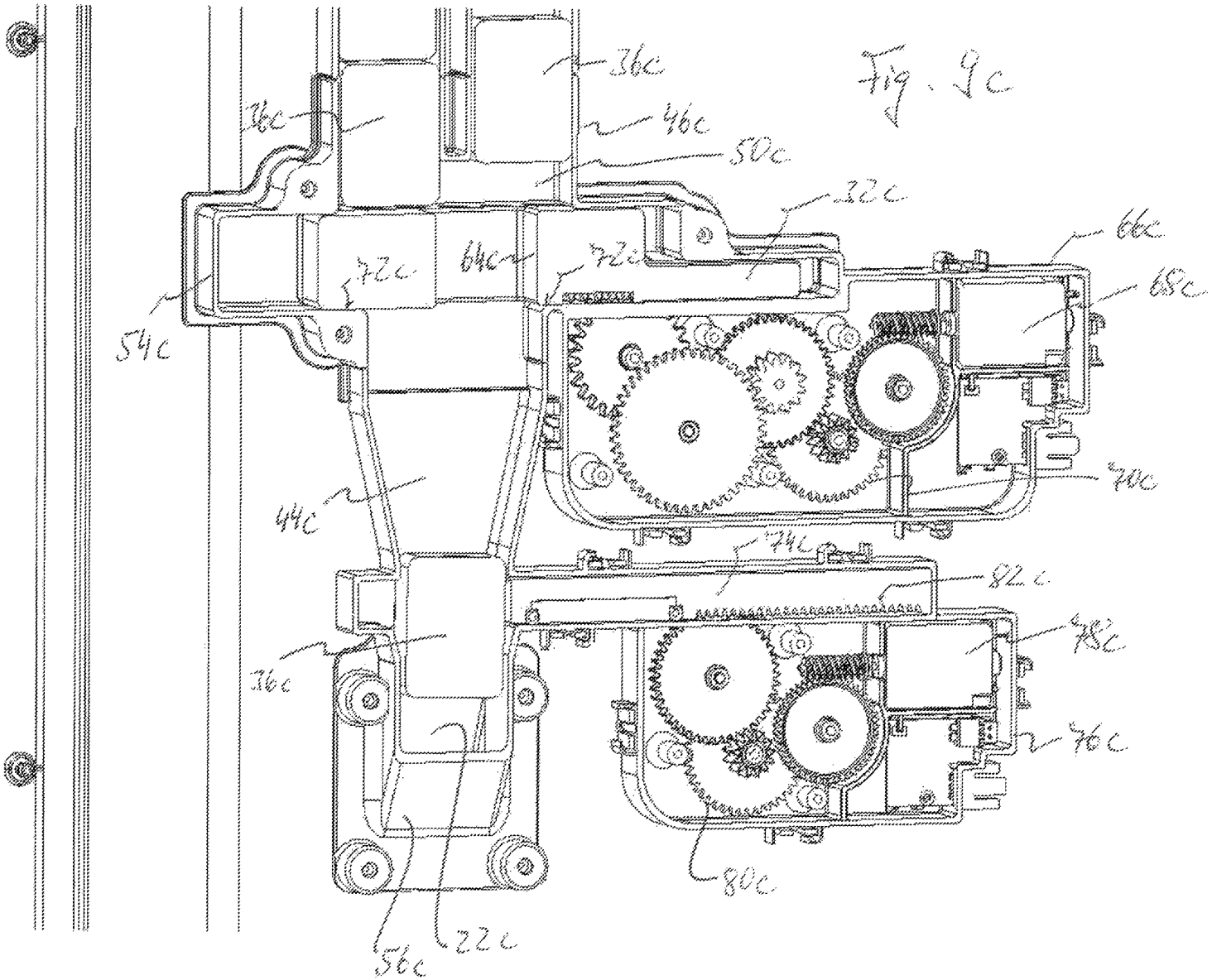
Figure 9A:
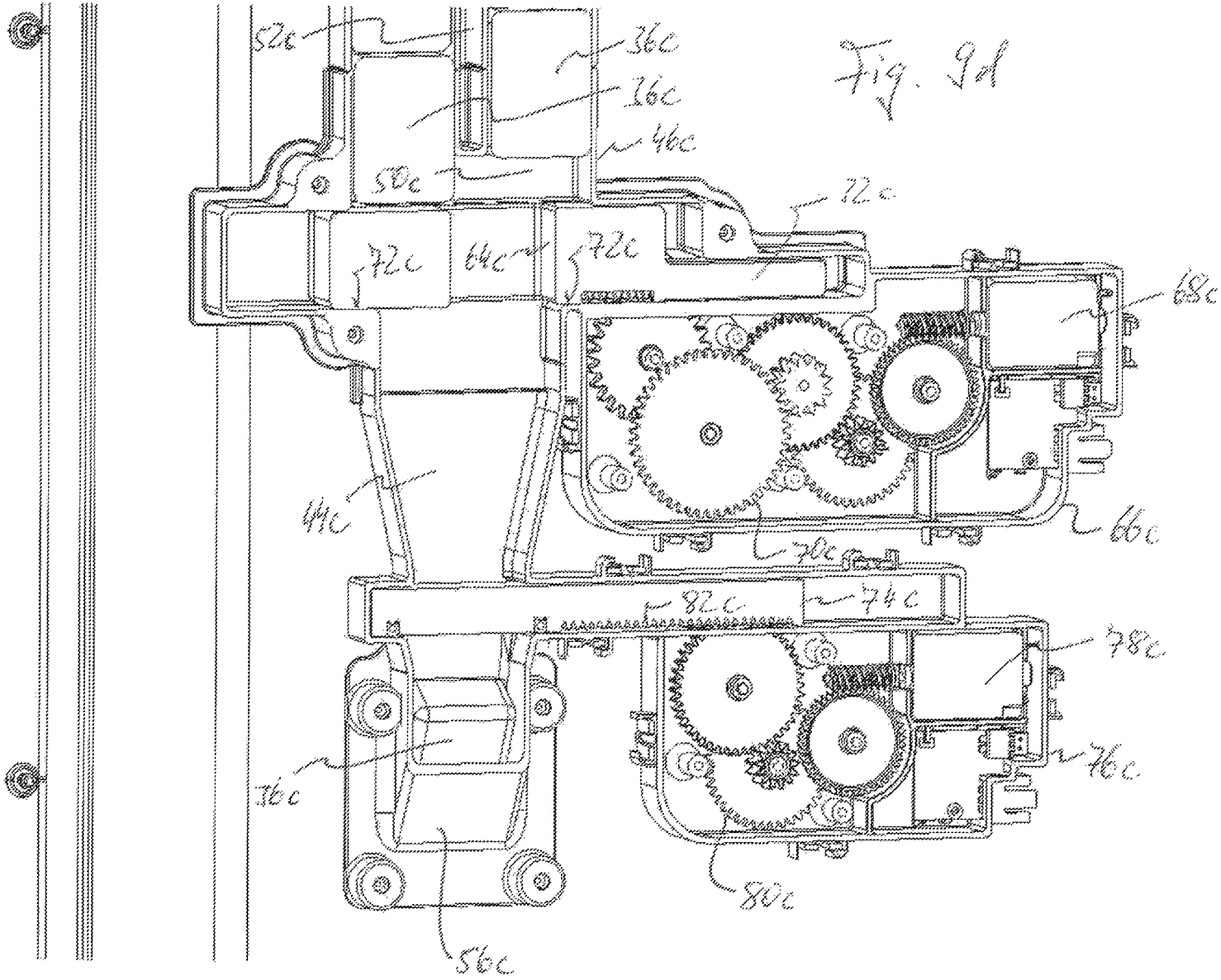

The next step in the extraction of the cleaning tablet 36*c*' is the transfer of the lock element 74*c* into an open lock position. This is illustrated in FIG. 9*c*. The cleaning tablet 36*c*' is then able to pass the lock element 74*c* and fall in the ejection channel 44*c* further in the direction towards the delivery opening 22*c*.

Finally, the arrival of the cleaning tablet 36*c*' at the delivery opening 22*c* is shown in FIG. 9*d*. The lock element 74*c* has here been brought back into its closed lock position.

Figure 10:
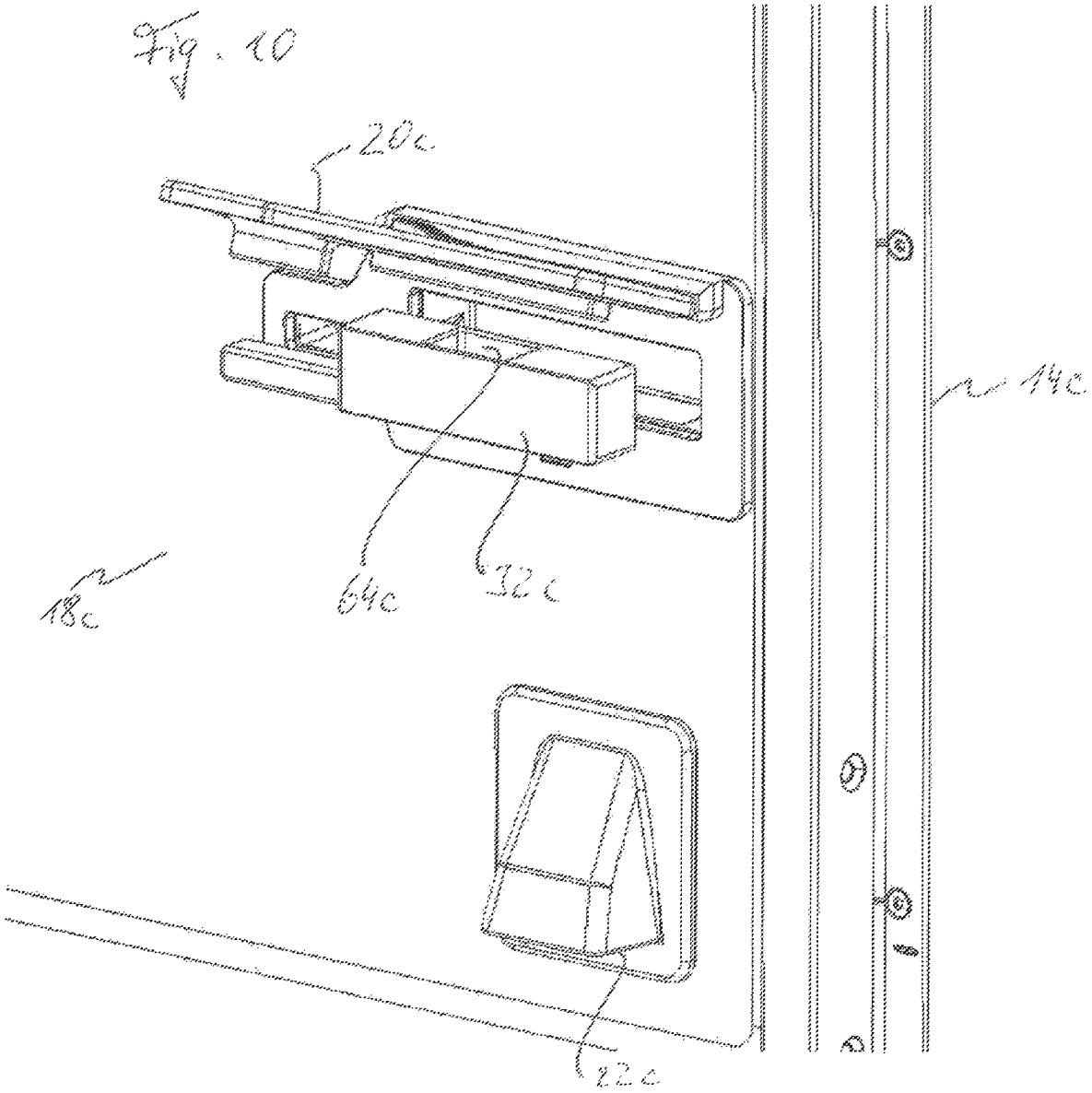
FIG. 10 shows an enlarged detail of FIG. 7 with an access flap to the tablet dosing system of FIG. 8 open, wherein an extractor slider of the tablet dosing system is shown removed from its installed position.

As illustrated in FIG. 10, it can be possible in some embodiments to obtain access to the extractor slider 32*c* by opening the maintenance flap 20*c* and to remove the extractor slider without having to remove the interior lining or/and the outer paneling of the door 14*c*. Such a removal of the extractor slider 32*c* can be necessary from time to time, for example, for maintenance purposes or for the purpose of cleaning the tablet dosing system.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A domestic dishwasher, comprising:

a wet chamber;

a door for closing the wet chamber; and a dosing system installed in the door, wherein the dosing system comprises:

a storage magazine delimited by walls, the storage magazine configured to store a cleaning substance;

an extractor for extracting a portion of the cleaning substance from the storage magazine; and a blower for generating a blowing air stream, wherein at least a portion of the blowing air stream is introduced into the storage magazine.

* * * * *